US005678256A

United States Patent [19]

Lea

[11] Patent Number: 5,678,256

[45] Date of Patent: Oct. 21, 1997

[54] BATHTUB STEP ASSEMBLY FOR USE IN BATHING DISABLED PERSONS

[76] Inventor: Brooke Casey Lea, 755 Makaala Dr., Wailuku, Hi. 96793, aka Janet Lee Case

[21] Appl. No.: 587,217

[22] Filed: Jan. 16, 1996

[51] Int. Cl.[6] ..... A47K 3/12

[52] U.S. Cl. ..... 4/538; 4/496; 4/559; 4/579; 52/182

[58] Field of Search ..... 4/496, 559, 571.1, 4/573.1, 578.1, 579, 538, 584, 541.1; 52/182, 184; D25/62, 63

[56] References Cited

U.S. PATENT DOCUMENTS

| | | | |
|---|---|---|---|
| D. 262,403 | 12/1981 | Wallin et al. | D24/38 |
| D. 279,712 | 7/1985 | Daly | D25/62 |
| 1,997,249 | 4/1935 | Dobbs | 4/173 |
| 2,204,929 | 7/1940 | Fairhurst | 4/146 |
| 2,306,934 | 12/1942 | Cade | 4/173 |
| 3,496,579 | 2/1970 | Petersen | 4/173 |
| 3,559,634 | 2/1971 | Lillywhite | 128/66 |
| 3,848,378 | 11/1974 | Witte | 52/184 |
| 3,971,080 | 7/1976 | Walker | 4/173 R |
| 4,034,425 | 7/1977 | Van Riemsdyck | 4/579 |
| 4,037,591 | 7/1977 | Sarno | 4/573.1 |
| 4,589,237 | 5/1986 | Dahowski | 52/169.7 |
| 4,599,835 | 7/1986 | Rinke | 52/184 |
| 4,928,329 | 5/1990 | Palmeri | 4/552 |
| 5,333,322 | 8/1994 | Weir | 4/578.1 |
| 5,341,524 | 8/1994 | Zellner | 4/555 |

FOREIGN PATENT DOCUMENTS

| | | | |
|---|---|---|---|
| 77529 | 5/1954 | Denmark | 4/519 |

*Primary Examiner*—Henry J. Recla
*Assistant Examiner*—Charles R. Eloshway
*Attorney, Agent, or Firm*—Richard R. Mybeck; Peter B. Scull

[57] ABSTRACT

A bathtub step assembly for use in bathing disabled persons. The step assembly has a plurality of planar surfaces disposed in spaced, generally parallel relationship to each other, the uppermost planar surface being coplanar with the top surface of the bathtub wall or walls that it is disposed adjacent to. The uppermost planar surface is also specifically shaped to provide adequate human buttocks support when the human buttocks engages the uppermost planar surface both when the human is disposed thereon with his/her back facing the bathtub and when the buttocks are pivoted approximately one-quarter turn to be in feet-first ingress position relative to the bathtub.

9 Claims, 2 Drawing Sheets

BATHTUB STEP ASSEMBLY FOR USE IN BATHING DISABLED PERSONS

The present invention relates generally to personal bathtubs for disabled individuals and more particularly to such bathtubs including means to establish convenient ingress and egress to such tubs so that handicapped persons may enjoy private bathing and the exuberance of doing it alone.

BACKGROUND OF THE INVENTION

Persons with certain physical disabilities and debilitating diseases such as M.S. suffer great distress because of their perceived inability to maneuver themselves through and over common obstacles that non-disabled persons readily, simply and routinely overcome. Thus, persons who are confined to wheelchairs incur many difficulties which fully functional persons overcome without any special effort at all. Such difficulties include negotiating flights of stairs, entering and exiting automobiles and the like. Perhaps less apparent, such persons also experience large problems when it comes to bathing. Ingress to and egress from conventional bathtubs is a most difficult, if not impossible maneuver for one not having full use of their legs. In fact, many such persons require the assistance of a third person to help them enter and/or exit a bathtub with the attendant indignity of having one's modesty violated. Because of matters of expense or otherwise, many disabled persons cannot afford to have personal assistants help them with daily baths; and thus, are forced to depend upon community care facilities or to go for extended periods without bathing, both of which are a source of emotional distress.

The art of bathing structures for invalids is replete with devices designed to provide better access to a bathtub or shower. For example, numerous bathing facilities are described in which doorway-type openings are formed in one or more side or end walls of the tub to provide simpler access to the bathtub. These include Zellner, (U.S. Pat. No. 5,341,524), and the other references found in International Class 4 subclass 555.

Other prior bathtubs which omit doorway-type access but instead use various combinations of steps and/or seats are taught by Palmeri, (U.S. Pat. No. 4,928,329), and Dobbs, (U.S. Pat. No. 1,997,249). Palmeri's bathtub/shower is explicitly directed toward wheelchair accessibility. Specifically, a bather would wheel his/her wheelchair up a short ramp to the shower end of the Palmeri assembly and from there maneuver out of the wheelchair and onto the tub end ledge. Then the bather, back first, moves his/her hips and buttocks down to a second level, and then again down a sloped surface to a third, anatomically contoured level. The bather's legs remain on the second level which, combined with the anatomical contouring of the entire bathtub, prevents the bather's buttocks and thighs from sliding so that a disabled person will not slip underwater and drown.

The Dobbs assembly, on the other hand, is not explicitly made for disabled persons although it utilizes a three step ingress/egress. Specifically, the Dobbs assembly provides for entry into the water by having the bather step down from floor level to a conveniently located corner step and from there down again to a second step and continuing down yet another step or two to the bottom of the assembly. The second step may then also be used as a seat for the bather to sit on while bathing if desired. Egress is achieved by the reverse process of climbing the steps to the top and then stepping out of the bath.

Nevertheless, there remain problems with the prior teachings in that, for example, the prior art bathtubs involve extremely elaborate and intricate devices and structures which obviously require complex manufacturing and installation processes when compared to the processes used for conventional bathtub/shower structures. In addition, they are quite expensive particularly for persons who, because of their disability, can not acquire and maintain regular employment. Therefore, there remains a need for simpler, less expensive bath and shower ingress/egress means for persons having diminished leg use.

BRIEF SUMMARY OF THE INVENTION

The present invention generally involves the strategic placements of a plurality of specially configured steps to provide handicapped persons with ingress and egress into and out of what otherwise can be a substantially conventional bathtub. This design provides special benefits to disabled persons, many of whom are wheelchair bound, by enabling them to easily and safely enter and exit a bathtub without third party assistance.

In particular, the present invention comprises a bathtub including a plurality of strategically designed steps which may be formed either for insertion into a pre-existing bathtub or may be formed as an integral part of a newly constructed bathtub. In preferred form, the uppermost of the plurality of steps will abut the inside face of at least one wall of the bathtub compartment and be of equal elevation and thus coplanar with the upper surface of the tub enclosure thereby creating a platform from which a person can begin the process of entering the bathtub. Additional descending steps are provided at strategically positioned elevations to allow the user to proceed from one to the next until the bottom of the bathtub is reached. The lowermost step preferably abuts the bottom of the bathtub.

The primary method of use of these steps by a person who, for example, has diminished leg use capacity, is as follows. First, such a person would, by wheelchair or otherwise, arrive at that wall of the bathtub compartment which is coplanar with the uppermost step. Then, the person would maneuver to place his/her buttocks and upper thighs on the uppermost step. Then, either before or after pivoting/swinging his/her legs into the bathtub, the person would maneuver his/her legs onto the next step down from the one he/she is seated upon and using his/her legs and/or arms as a fulcrum, move the buttocks down to the next lower step between the feet. Continuing in this fashion, one step after another, the person gradually enters the bathtub. The reverse process is used for exiting the bathtub, that is, the feet, forelegs and/or arms are used to fulcrum the buttocks up one step at a time until full egress is achieved. Handrails may be provided along the upper surface of the bathtub walls for gripping while a person maneuvers between the wheelchair and the uppermost step and in moving up and down the steps. Personal assistants, when present, may use the steps and handrails to assist in maneuvering disabled persons although, as stated, the principal purpose of the present invention is to eliminate the need for such attendants and allow the user, whenever he/she wishes, to bathe in complete privacy.

Accordingly, the primary object of the present invention is to provide an improved, simple and relatively inexpensive means to enable disabled persons to enter and exit bathtubs alone and without dependence upon others to accomplish this goal.

A further object of the present invention is to provide independent means which are readily installable in existing bathtubs to enable them to be more easily used by disabled or handicapped individuals.

A still further object is to provide means which allow for simple conversion of existing bathtubs to enable ready ingress and egress by handicapped individuals.

Another object is to provide means which enable persons with diminished lower body capacity alone or with diminished upper body capacity to enjoy the luxury of bathing alone.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF THE PREFERRED EMBODIMENT

Figure 1:
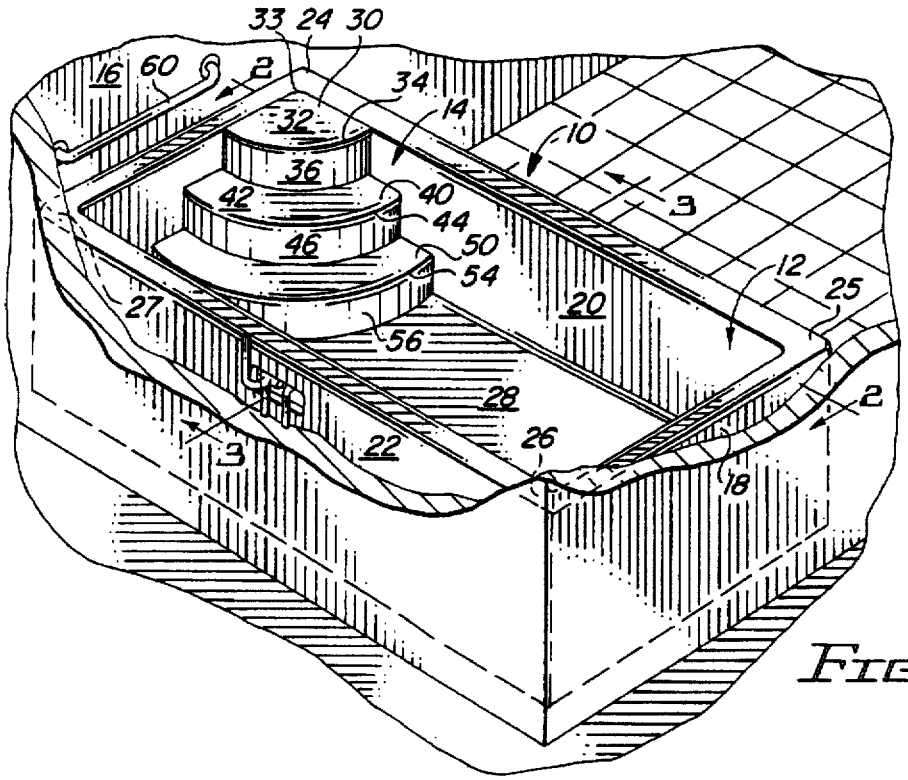
FIG. 1 is an isometric view of a bathtub having step means operatively associated therewith in accordance with the present invention.

The present invention relates generally to bathtubs and more particularly to means and methods for augmenting or replacing conventional bathtub structures with an improved bathing facility which is more accessible to persons having certain physical disabilities.

As shown in the accompanying drawing, particularly in FIGS. 1–3 and 8, an improved-access bathing structure embodying the present invention is identified by the general reference numeral 10. Bathing structure 10 generally comprises a bathtub 12 in operative association with step means 14 which is disposed within bathtub 12 either as an addition or as a integral part as shown.

Bathtub 12 comprises first and second end walls 16, 18 and first and second side walls 20, 22. In the embodiment shown, walls 16, 18 and 20, 22, are each substantially upright and integrally engage each other at corners 24, 25, 26, and 27 respectively to complete a watertight enclosure. The bottom surface or floor 28 of bathtub 12 is likewise integrally connected to the lower edges of walls 16, 18, 20, 22, to complete bathtub 12 in a watertight manner. Thus, bathtub 12 as shown is substantially rectangular in shape and although, as will appear other shapes can be employed so long as one corner thereof provides a complementary surface to secure the discrete step means 14 thereto. The definition of conventional bathtub shapes includes those having extra length so that a person can fully recline in the bathtub 12, even when step means 14 are installed therein. Extra long bathtubs are in fact preferred.

Figure 3:
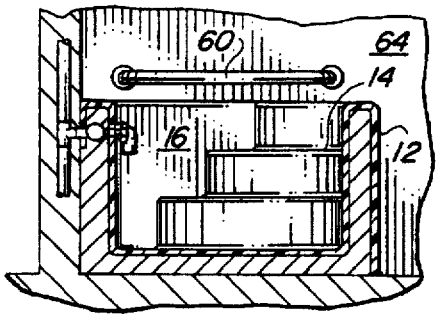
FIG. 3 is a cross-sectional view taken on line 3—3 of FIG. 1.
Figure 4:
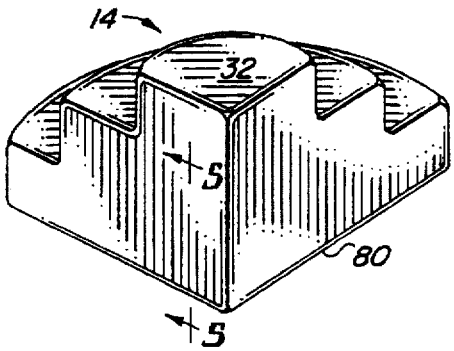
FIG. 4 is a isometric view of step means embodying the present invention.

Step means 14, as shown in FIGS. 1 and 3, is disposed in one corner of bathtub 12, such as corner 24, and comprises a plurality of steps including a top step 30 which is preferably disposed so that its upper, substantially horizontal surface 32 is substantially coplanar with the upper surface of adjacent end and side walls 16 and 20. As shown in FIGS. 1 and 4, top surface 32 presents a substantially 270° corner 33 which complements corner 24 at the intersection of walls 16 and 20. Top surface 32 as shown presents a curvilinear outer edge 34 which extends between end wall 16 and side wall 20. As shown in FIGS. 1 and 4, curvilinear edge 34 defines quarter circular arc which provides top surface 32 with the plan shape of a quarter circle. As discussed in more detail below, edge 34 may incorporate other configurations such as straight lines or other different curved shapes which will of course vary the shape of planar surface 32. Thus, partially ovular and/or undulatory curves, and the like may be freely substituted for the quarter circular shape shown.

Top step 30 also encompasses a riser portion 36 which extends in a substantially vertical plane between curvilinear edge 34 and second step 40. Second step 40 is also provided with a substantially horizontal planar surface 42 which is operatively associated with and extends outwardly from riser portion 36. Horizontal surface 42 likewise has an outward edge 44 which is offset an effective distance from riser 36, for a purpose to be described later and is preferably concentric with edge 34. In a fashion similar to that described above, second step 40 also is provided with a riser portion 46 which extends vertically between outward edge 44 and third step 50.

Third step 50 also has a substantially horizontal planar surface 52 and a configured outer edge 54 as well as a third riser portion 56 which, as shown here, extends between outer edge 54 and bathtub floor 28. The preferred embodiment of step means 14 thus provides a quarter-circular tiered structure as shown in FIGS. 1–3.

Dimensions for each of the plurality of steps in step means 14 may be standardized for a plurality of step means 14 or may be variable depending upon the particular installation desired and the size of the person being accommodated. For example, if a bathtub has a depth of eighteen (18) inches, the step means 14 to be used therein would utilize risers 36, 46, and 56 of approximately six (6) inches in height and the radial dimension of surfaces 32, 42 and 52 would preferably be twelve (12) inches, ten (10) inches, and eight (8) inches, respectively.

Figure 2:
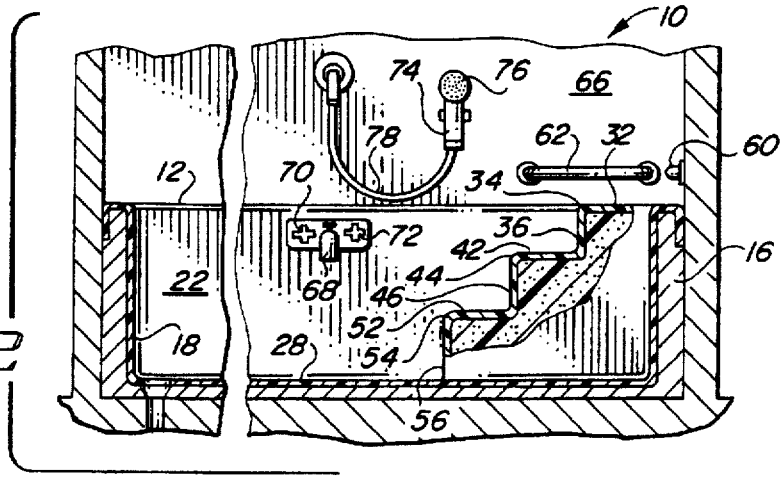
FIG. 2 is a cross-sectional view taken on line 2—2 of FIG. 1.
Figure 8:
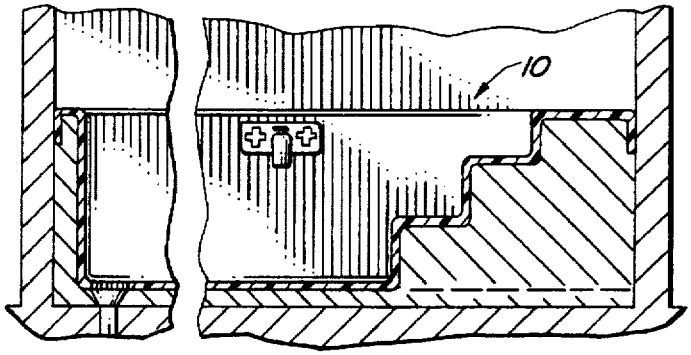
FIG. 8 is a side elevation of an alternative embodiment of the present invention in which said step means and tub means are formed in an integral structure.

Some further optional features are also shown in FIGS. 1–3. For example, handrails 60 and 62 may also be installed adjacent bathtub 12 to facilitate the movement of the user into and out of the bathtub. As shown, first handrail 60 is attached to a first bathroom wall 64 while second handrail 62 is attached to adjacent, second bathroom wall 66. Alternatively, handrails 60, 62 may be affixed to bathtub walls 16 and 22 or otherwise secured in an appropriate useful position. Also shown are conventional bath fixtures, such as faucet 68, water control knobs 70, 72 and showerhead assembly 74 which as shown includes a showerhead 76 connected to shower hose 78. As shown in FIGS. 1, 2 and 8, these bath fixtures are preferably and optionally disposed in an apparently unconventional fashion on side wall 66 which facilitates use as will be described below.

The manufacture of the bathing assembly of the present invention showcases several of its greatest benefits. First, step means 14 can be manufactured as a discrete unit which is independent of bathtub 12 which allows step means 14 to be operatively associated with existing bathtubs. Alternatively, step means 14 may be simultaneously and integrally formed with bathtub 12 to form one, indivisible and unitary bathing assembly 10. The benefit of this type of manufacturing is that conventional molds and other conventional processes need not be significantly altered to create a bathing assembly 10 in accordance with the present invention. Thus, conventional plastic-molded bathtub molds need only be altered by the simple inclusion of steps 30, 40, 50 as an integral part thereof to create bathing assembly 10 which can then be simply installed in current fashion in any conventional bathroom. Note, in such a practice bathtub 12 will be longer than conventional home tubs to enable the user to fully recline even with step means 14 incorporated therein.

The manufacture of discrete step means 14 for installation into preexisting bathtubs can be accomplished by any of a number of known processes using a variety of materials. For example, solid units may be made from sturdy, heavy starting materials such as concrete formed in the desired shape, or concrete blocks, bricks and the like may be put together in known fashion and filled and shaped to present the one-quarter wedding cake shape shown and then these sorts of units would preferably be covered with water sealing materials like plastic or other lining materials and then, relatively permanently moved into place.

More easily, step means 14 may be formed from other materials including plastics and the like, which can be molded into the desired shapes. Step means 14 made from these lighter materials may be hollow or solid but in either case would require some sort of attachment to bathtub 12 to achieve its full usefulness. The type of anchoring chosen will depend on the degree of permanency desired. If a permanent placement is sought for one of these lighter step means 14, water-resistant bonding agents such as glues or epoxies can be used to affix the step means in place within a conventional bathtub. Other permanent attachment means may also be available including using more drastic measures such as cutting holes or other openings (not shown) into an existing bathtub which openings would then receive certain protuberances (also not shown) formed on a step means 14 for this purpose. The coaction of the protuberances and the corresponding bathtub openings would be primarily designed to prevent lateral slippage or other movement of the step means during use as will be described below.

Figure 5:
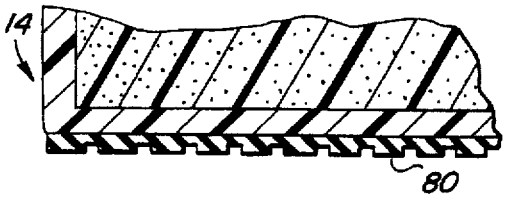
FIG. 5 is a cross-sectional view taken on line 5—5 of FIG. 4.

When a given bathtub is subject to multiple users, a simple removable step means 14 is achieved by detachably securing step means 14 to bathtub 12. Many equivalent means achieving such an attachment without slippage are available. For example, depending on the weight of the step means, certain non-skid, frictional coverings, pads or appliqués 80 as shown in FIGS. 4 and 5, may be affixed to the bottom of step means 14 which will coact with bathtub floor 28 to maintain step means 14 in its preselected position. Suction cup designs as are used to apply conventional bathtub non-skid mats to a bathtub floor may also be used. Alternatively, permanent or semi-permanent stops or notches (not shown) may be attached or formed on the bottom floor or side walls of a bathtub around the periphery of the exposed points of contact between the step means 14 and the bathtub 12 to prevent relative movement therebetween. Another method involves the use of vertical slide tracks affixed one to side wall 20 and another to end wall 22. These slide tracks are especially adapted to receive vertical flange portions (not shown) which are defined on the outer edge of riser portion 56 of third step 50. As with the other stops and notches discussed, these slide tracks may be permanently affixed (glued, epoxied, bolted, or the like) in place or detachably attached.

Figure 6:
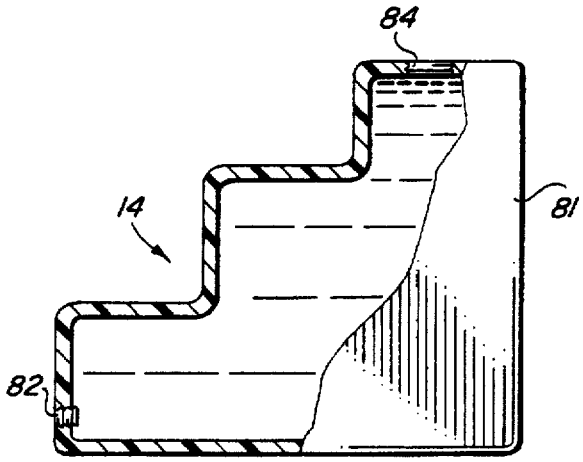
FIG. 6 is a cross-sectional view of alternative step means embodying the present invention.
Figure 7:
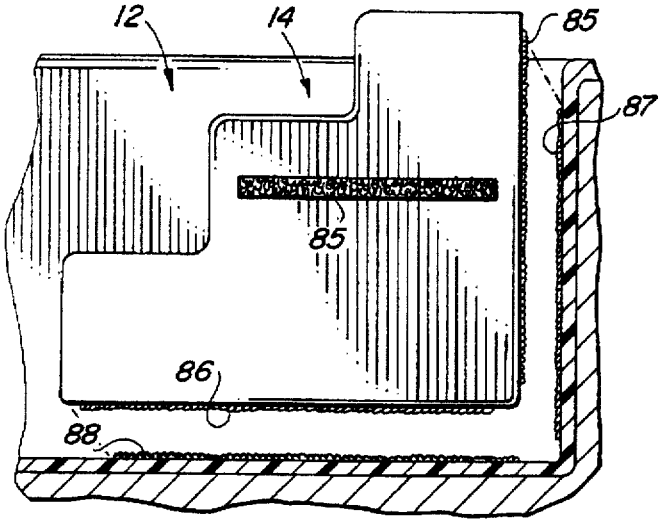
FIG. 7 is a side elevation partially fragmented, showing the installation of step means into an existing bathtub.

Two of the optional designs for removable step means 14 are specifically shown in FIGS. 6 and 7. FIG. 6 shows a hollow step means 14 having a body portion 81 into which openings 82 and 84 are defined which are sealably closable to enable body portion 81 to be filled with water, or the like, and provide step means 14 with sufficient weight to prevent it from moving laterally when in use. FIG. 7 shows another alternative embodiment in which hook and loop (so-called VELCRO®) fasteners 85, 86 are attached to body portion 81 of step means 14 in registry with complementary fasteners 87, 88 mounted on bathtub 12. Thus, step means 14 is detachably attached to bathtub 12 by mating fasteners 85, 87 and 86, 88, respectively, as shown in FIG. 7.

FIG. 8 shows still another embodiment of the present invention in which step means 14 is integrally formed with bathtub 12 to create a unitary bathing unit 10. When produced in this fashion, a plurality of bathing units 10 can be simply mass produced using conventional molding techniques or other known manufacturing procedures.

The use of the present invention is substantially the same for both the permanent, integrally formed bathtub step unit 10 (as shown in FIG. 8) and the independent step means 14 operatively installed into a bathtub 12. With either the integral bathtub step means assembly 10 or the assembly 10 created by the installation of discrete step means 14 into a preselected bathtub 12, the method of using the assembly 10 is the same as will now be described.

First, a person with certain physical disabilities (particularly a person having reduced leg use capacity) approaches the bathing assembly 10 which in most instances will be from a wheelchair (not shown), in a position adjacent the end of the bathing assembly 10 where step means 14 is located. The person (hereafter "the user") then maneuvers into a seated position on horizontal planar surface 32 of top step 30. Note, it is assumed that the user will have sufficient arm strength to perform this and all other requisite maneuvers without assistance in order to achieve the stated object of bathing without the presence of a third person assistant. It should be understood, however, that all of the following procedures are described with the understanding that the present invention also provides great benefit to those persons whose physical disabilities may even require the assistance of a third person in order to perform any particular maneuver.

Though optional, it is preferable that the user enter the bathing assembly 10 feet-first. Thus, the user will have to place the user's legs and feet so that they extend downwardly into the bathing assembly to provide a feet first entry. A user may be able to achieve this feet-first position by either first putting the legs and feet on upper surface 32 and then moving the rest of the user's body from the wheelchair (if used) into a seated position on upper surface 32 where the buttocks is interposed between the user's feet, next, moved down onto the next lower surface, e.g. surface 42, and the user then moves his/her buttocks between the feet on surface 52 and so on until surface 28 of tub 12 is reached. Alternatively, the user can first maneuver to place his/her buttocks and thighs on top surface 32 with the user's back facing bathroom wall 66 and then, simultaneously pivot the user's body and swing the user's feet and legs up over bathtub side wall 20.

As indicated, the next maneuver for entering bathing assembly 10 is to move the user's buttocks down from top step 30 to second step 40. Please note that some users may have some leg muscle use and may thus be able to use their legs to some extent during the process of moving onto top step 30 as well as from one step to another. Thus, a user with some leg control could put their feet on, for example, step 30 and use their legs to guide their buttocks onto step 30 and in a seated position between the user's feet. Those without such control can nonetheless utilize the foreleg as a fulcrum in achieving the desired relocation until the tub is entered.

The remaining procedural movements for the user to enter the bathtub include a general repetition of these movements; more specifically, the user would then move his/her buttocks down from second step 40 to third step 50, and from there down again from third step 50 to bathtub bottom 28. Again, if the user has some leg muscle control, then that user could use his/her legs and feet for assistance during this process. Specifically, in moving from top step 30 down to step 40, for example, this user would, being seated on step 30, then place his/her feet on step 40 and then move his/her buttocks down to step 40 to a position between his/her feet. This process is then repeated for each step (e.g. to step 50) until bathtub bottom 28 is reached.

The number of downward movements the user will make will depend upon the number of steps present in the particular step means 14 being used and/or upon personal choice in that a user may decide to remain seated on any of the steps during the bathing process. Moreover, the user may choose to use the lowermost (or any other) step as a headrest if they were to choose to recline in the bathtub.

Further regarding the ingress process just described, the user may use optional handrails 60, 62 to assist in these movements. The user could hold a side handrail 62 with one of his/her hands and hold end handrail 60 with the other hand. The user would then use these handrails to support his/her body weight while performing the movement of maneuvering his/her buttocks down from top step 30 to second step 40 and so on. These hand rails may also be used in similar fashion for the other step movements, and/or a plurality of lower handrails (not shown) could be provided for use during the subsequent discrete movements between the different steps. Moreover, this is only one possible means for accomplishing such movement because a user's hands could also engage other nearby structures to effectuate the same result. For example, a user could put one or both hands on the step to be moved from or on the tops of one or more of the bathtub side and/or end walls 20, 22, or 16. This process is particularly suited for a user with only limited leg use to perform on his/her own thus eliminating the need for assistance by other persons. However, it should be kept in mind that outside physical assistance for users having reduced arm use as well as reduced leg use may still be required from, for example, a human assistant or through other known mechanical means. Thus, the structures disclosed and the processes described will be useful for users with all sorts of disabilities.

To complete the process of bathing, it should be noted that the bathing water (not shown) can be drawn either before or after the user enters the bathtub. On one hand, a water-filled bathtub would provide a buoyancy effect on a human body as it enters and/or exits the bathtub and would thereby ease the step by step process in that a physically challenged user would be required to support less weight during each movement. In such a situation, water faucet(s) and handles should be provided in conventional fashion protruding from the wall at either end of the bathtub. However, greater control over water fixtures during the actual bathing process is provided to a physically challenged user by having water faucets, shower heads, handles and the like disposed on side wall 22 as shown in FIG. 2. Thus, a user taking a bath could draw more water or use a movable showerhead such as showerhead assembly 74, as shown, at any time during the bath.

Upon completion of the bathing process, the user would then exit the tub in a step-by-step process up step means 14 making each movement described above for ingress in reverse order. First, he/she would move his/her buttocks up onto the planar surface 52 of third step 50 from bathtub bottom 28; then up to planar surface 42 of second step 40, and again up to planar surface 32 of top step 30 and, after drying off, return to their wheelchair or other transportation means (not shown). As above, if desired, the bath water may be left in the bathtub until the user has exited so that it may provide the buoyancy effect described above. Also, if a removable step means 14 is used, it may be removed at this or any later point so that the conventional bathtub 12 may be used by others not desiring or requiring the presence of step means 14.

The user exits the bathtub, bathing assembly 10 may be readily cleaned as by spraying the surface thereof with the showerhead 76, and let it air dry. Thereafter, discrete step means 14 can be removed and set aside until it is again needed.

Numerous alternative shapes and sizes of step means 14 particularly the planar surfaces 32, 42 & 52 thereof may be created within the spirit of the present disclosure. For example, instead of the quarter circular form shown, curved edges 34, 44 and 54 may be straight (thus forming triangularly shaped surfaces), squared off (thus forming rectangularly shaped surfaces), ovular, undulatory or any of a number of known configurations. Curved edges 34, 44 and 54 may also be made to meet at different locations on the bathtub walls or can be configured to traverse the bathtub width and meet with only the two side walls 20, 22. As above, straight, curved, or the like edges could be used here as well. Still further, edges 34, 44 and 54 could be configured to meet with only one side wall, such as against side wall 20 in two places. Thus, for example, a half-circular or a rectangular outline 34 may be fashioned for a top step 30 (with similar shapes also for second and third steps 40, 50), that would thus make step means 14 abut only side wall 20.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A step assembly for use in bathing a disabled person in a conventional bathtub, said step assembly comprising a body portion removably securable in said bathtub having an undersurface, a back surface, a side surface and a plurality of substantially horizontal planar surfaces, one of said planar surfaces being a top planar surface which is sufficiently sized and configured to support a human seated thereon both when the human is seated with his/her back facing the bathtub and when the human is pivoted into a feet-first ingress position, and wherein said top planar surface is adapted to be disposed in coplanar relationship with the top edge of the bathtub; each of said planar surfaces being disposed in spaced generally parallel relationship to each other and configured to operably fit within a bathtub to provide adequate human body support to a user seated thereupon while incrementally obtaining ingress into and egress out of said bathtub.

2. A step assembly according to claim 1 in which each of said planar surfaces has a curvilinear edge when viewed in plan.

3. A step assembly according to claim 1 in which each of said planar surfaces is quarter-circular in plan.

4. A step assembly according to claim 1 in which said step assembly is adapted to be disposed in abutting relationship to a portion of said bathtub.

5. A step assembly according to claim 1 in which said undersurface of said body portion further comprises a non-skid device for making said step assembly stable relative to said bathtub when in use.

6. A step assembly according to claim 5 in which said non-skid device comprises a rubber appliqué attached to said undersurface of said body portion.

7. A step assembly according to claim 1 in which said body portion is substantially hollow and further comprises a closable lower opening and a closable upper opening defined therein to enable said body portion to be filled with a filler material to enhance the weight thereof and make said step assembly relatively immobile during use.

8. A step assembly according to claim 7 in which said filler material is water.

9. A step assembly according to claim 1 which further comprises hook and loop fasteners mounted on the undersurface of said body portion for coacting with complementary hook and loop fasteners mounted in registry therewith on said bathtub.

* * * * *